United States Patent [19]

Nelson

[11] 4,336,671

[45] Jun. 29, 1982

[54] SURFACE CLEANING APPARATUS

[76] Inventor: Robert T. Nelson, P.O. Box 763, Oklahoma City, Okla. 73101

[21] Appl. No.: 143,731

[22] Filed: Apr. 25, 1980

[51] Int. Cl.[3] ..... B24C 3/06
[52] U.S. Cl. ..... 51/424; 51/429
[58] Field of Search ..... 51/429, 424, 425

[56] References Cited

U.S. PATENT DOCUMENTS

| | | | |
|---|---|---|---|
| 3,756,377 | 9/1973 | Guff | 51/429 X |
| 3,877,175 | 4/1975 | Snyder | 51/429 X |
| 3,977,128 | 8/1976 | Guff | 51/429 X |
| 4,035,958 | 7/1977 | Nishio | 51/429 X |
| 4,052,820 | 10/1977 | Bergh | 51/429 |
| 4,202,142 | 5/1980 | Van Fossen | 51/429 X |

FOREIGN PATENT DOCUMENTS 2756786 6/1978 Fed. Rep. of Germany .

*Primary Examiner*—Nicholas P. Godici
*Attorney, Agent, or Firm*—Bernard, Rothwell & Brown

[57] ABSTRACT

A surface cleaning apparatus utilizing abrasive projected at high velocity against the surface being treated. The apparatus defines an opening in an enclosure through which abrasive is propelled in a high velocity stream or blast to impact against the surface. A pathway in communication with the opening receives and directs rebounded, spent abrasive to a collection bin. A rotating brush within the boundary of the opening of the enclosure and the kinetic energy of the abrasive are used to direct the spent abrasive in the pathway. A recycling apparatus is integrated within other elements in the enclosure to collect spent abrasive rebounded in pathway for return to the high velocity blast stream.

7 Claims, 2 Drawing Figures

SURFACE CLEANING APPARATUS

The present invention is directed to a surface-treating apparatus for directing abrasive at high velocity against the surface in order to remove rust, dirt, paint or other deposits. The apparatus is uniquely adapted to permit abrasive cleaning substantially closer to walls and other obstructions of the machine and in narrower quarters and walkways than other available machines. The apparatus is constructed in a compact manner that permits effective surface-treating with good clean-up of abrasive particles deposited on the surface being treated. The surface-deposited abrasive can be recovered by a device located immediately adjacent the blast area and the recovered abrasive is moved from the surface and into the flow path of the abrasive for return to the blasting device through the use of the kinetic energy of the abrasive particles traversing a flow path which includes the blast and rebound movements of he abrasive particles. The rebounded particles are returned to the blasting device for reuse. An elevator system can be employed for returning the spent abrasive to the blasting device and the construction of the elevator, as well as the manner of cleaning abrasive particles deposited on the surface, enhance the ability of the machine to operate in narrow pathways and in close proximity to side walls and other obstructions.

Previous surface-cleaning devices have utilized vacuum or magnetic means or high velocity abrasive particles for removing rust, paint, dirt or other deposits from the surface. Examples of such equipment are shown in U.S. Pat. No. 3,034,262 issued May 15, 1962 to Eugene Pawlson; U.S. Pat. No. 3,380,196, issued Apr. 30, 1968 to George Anthony Mabille; and U.S. Pat. No. 3,448,544, issued June 10, 1969 to Michael Alexander Pierre Cardon; and U.S. Pat. No. 3,691,689, issued Sept. 19, 1972 to James R. Goff. The devices described in the latter patent employ a rotating brush located apart from the blast area for recovering spent abrasive deposited on the surface being treated. In the operation of such equipment there can be substantial losses of abrasive experienced. Recovery systems for the spent abrasive have also involved the use of conveyor systems which move along a path substantially transverse to the path of movement of mobile machines and the conveyor serves to lift spent abrasive to the blasting device. This type of apparatus is fairly bulky and its maneuverability leaves something to be desired, making operation close to walls and other obstructions difficult, if not impossible.

The surface-treating apparatus of copending application Ser. No. 752,787, filed Dec. 20, 1976, embodies features that take advantage of the rebound energy of the abrasive in recovering the spent particles in a collection bin from which the particles are returned to a hopper for supplying abrasive to the blasting device. The device employs a transversely moving elevator for lifting the particles from the collection bin to the hopper, and as a result is rather bulky and difficult to handle and use in restricted areas. Also, the brush provided for cleaning the surface of deposited abrasive is located to move these particles into the area of the collection bin and elevators. This location of the brush adds to the bulky nature of the device and in some circumstances there may be a substantial amount of solids retained by the treated surface thereby necessitating extensive clean-up operations after the surface is treated.

The present invention solves the foregoing difficulties to a considerable extent and provides a compact machine that is readily maneuverable and capable of treating surface areas close to obstructions such as walls and the like. These advantages are afforded by having the means for removing deposited abrasive from the surface being treated, positioned in the vicinity of the opening in the device through which the high velocity abrasive is propelled against the surface. The abrasive pick-up device is particularly advantageous in moving the surfaced-deposited particles from the surface and into the main flow of abrasive passing from the blasting or propelling device to the surface being treated and into their rebounding conduit for recycling the spent particles for reuse in the blasting device. It is particularly desired that the surface-deposited abrasive be swept upwardly into the path of the moving particles between the blasting device and the opening opposite the surface being treated. Moreover, the sweeping device can be located in or closely adjacent this opening and this need not extend substantially beyond the edges of the opening. As a result the housing or enclosure surrounding the opening may define the maximum transverse dimension of the device and thereby permit its effective use adjacent obstructions while providing maximum maneuverability of the machine and excellent removal of deposited abrasives from the treated surface.

The invention is further advantageous in providing an elevator which travels longitudinally, rather than transversely, of the machine. Consequently, the maximum width of the equipment is not defined by an elevator path for returning spent particles to the blasting device, and, in fact, the elevator need not extend the width of the machine beyond the housing for the blast opening. As a result, the ready maneuverability of the machine and its capability of treating surface areas close to obstructions are retained. Conveniently, this type of elevator can be used with advantage in conjunction with the collection bin for rebounded particles of the general type disclosed in said application Ser. No. 752,787.

Other features of the invention as well as the features discussed above will become apparent from the Detailed Description of the Preferred Embodiment which follows hereinafter.

DETAILED DESCRIPTION OF THE PREFERRED EMBODIMENT

Figure 1:
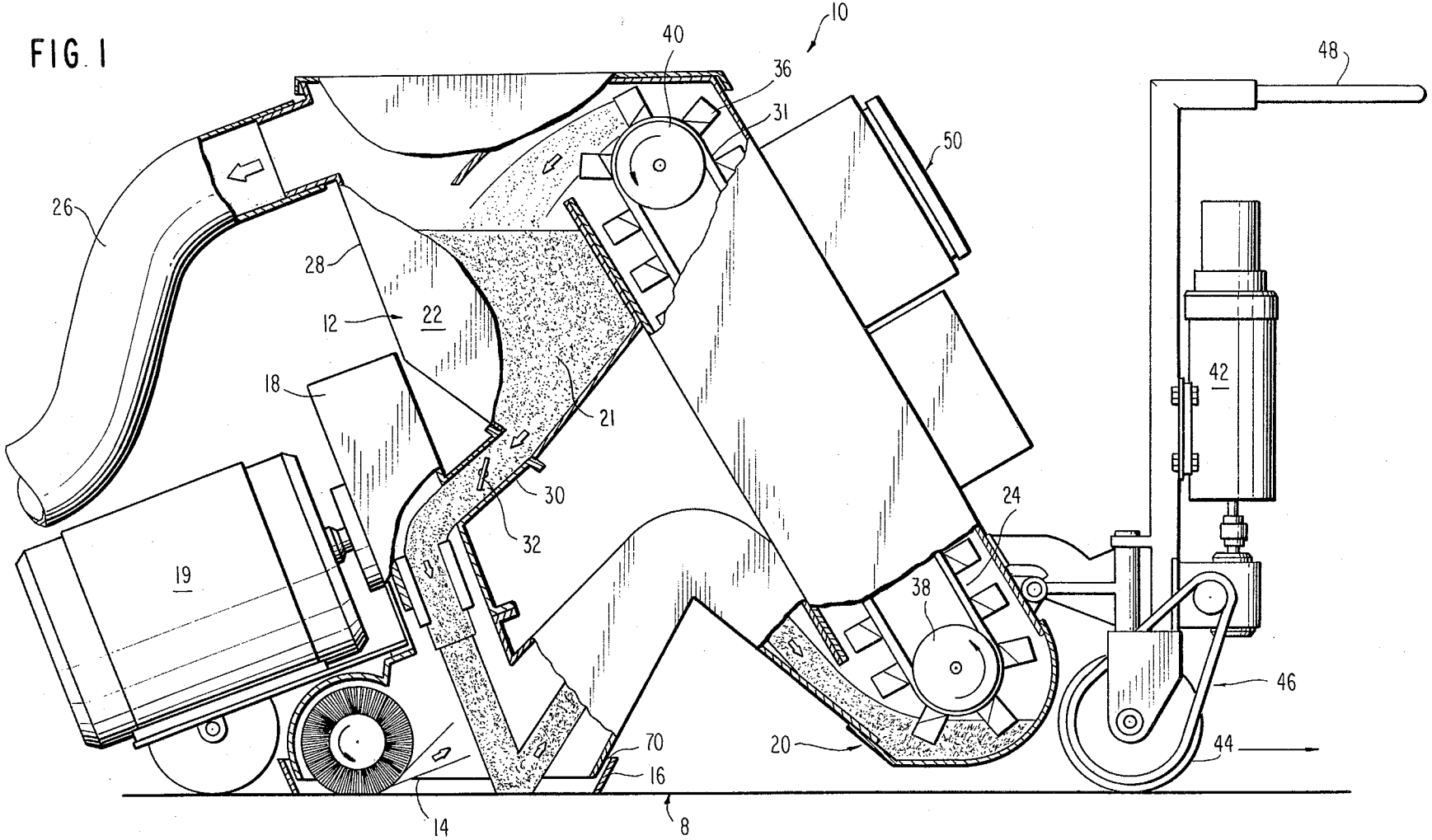
FIG. 1 represents a side view, partly in section, of a self-propelled, surface-cleaning apparatus of this invention.

The surface-cleaning apparatus as shown in the drawings includes blasting machine 10 having an enclosure 12 for carrying shot material as cleaning abrasive along with other elements of the apparatus to propel the shot toward the surface to be cleaned (hereafter surface 8) and recycle the shot after it has been recovered. The machine is preferably moved forwardly to the right as shown in FIG. 1. An opening 14 is located on one side of the enclosure 12, bottom side as shown in FIG. 1, for exposing a portion of surface 8 to the enclosure as machine 10 is moved along a path across surface 8. A centrifugal wheel 18 driven by high speed electric motor 19 propels the shot material toward the opening 14 at sufficiently high velocity to abrade and clean surface 8 being treated and to impart sufficient residual kinetic energy to the shot for collection purposes. Normally the centrifugal wheel may operate at about a 1000 to 4000 rpm. Other projecting means such as those utilizing compressed gas streams rather than centrifugal force may also be used; however, the centrifugal wheel is typically more efficient and thus preferred in this embodiment. The centrifugal wheel employed is a conventional, commercially available device.

As a result the impact of the shot against the surface generates a considerable amount of debris. Circumscribing opening 14 is a flexible seal 16 to substantially prevent the shot, dust and other debris generated during the blasting process from escaping into the surrounding atmosphere.

From the hopper 22 the abrasive is delivered to the centrifugal wheel 18 by gravity and funnelled into the center of the rapidly rotating wheel. Between centrifugal wheel 18 and hopper 22 a valve 32 is provided to control the rate at which the shot is delivered. As can be seen in FIG. 1, wheel 18 is arranged at a delivery angle to the perpendicular to deliver shot at high velocity to the surface to be treated at a corresponding angle. From this delivery angle the shot 21 delivered will rebound from surface 8 at an angle of reflectance to the delivery angle with sufficient kinetic energy remaining to facilitate recovery of spent shot. Collection bin 20 is provided, as shown in FIG. 1, forwardly of opening 14 to collect the spent abrasive rebounding from surface 8. Conveyor or elevator system 24 is arranged in the enclosure to remove the spent shot from collection bin 20 and carry that shot for disposal to hopper 22. Rotating brush 54 is located transversely within the enclosure and within the boundary defined by opening 14 and behind the primary blast area, to direct residual shot, dust or other debris which collects on the surface into the path of the abrasive. As shown, this material is swept somewhat upwardly into the blast portion of the path of the abrasive. As a result, the surface-deposited material so recovered is conveyed along with the shot to collection bin 20.

For moving machine 10 across the surface 8 an electric motor 42 is provided in conjunction with a conventional chain and sprocket system to drive wheel 44. A manual steering mechanism 48 permits the operator to steer the machine 10 through the desired path.

The above is a general description of various elements that can be included in the blasting apparatus. These elements as other aspects of the device shown in the drawings will be described in more detail hereinafter such that the features of the various parts can be better appreciated in conjunction with their interaction as described.

Elevator system 24 is part of the recycling system by which spent abrasive is returned to the hopper 22. As can be seen in FIG. 1, elevator system 24 is comprised of a lower wheel 38 and an upper wheel 40 both of which rotate in counterclockwise direction. Sheaved about these wheels 38, 40 is a conveyor belt 31 which in turn carries a series of buckets 36 spaced equally about the entire perimeter of belt 31. Upper wheel 40 is located above the hopper 22 and rearwardly of lower wheel 38 such that the movement of belt 31 and buckets is at an angle to the vertical. With this configuration the buckets as they are moved through collection bin 20 pick up the spent shot for dumping into hopper 22. The speed of the conveyor belt 31 can be controlled so that it is sufficient for the shot to be more or less thrown from the buckets 36 into hopper 22 as the buckets pass over wheel 40.

As explained above other conveyor systems for removing shot from a collection bin and recycling that shot for use in a blasting device have employed belts and buckets along a path substantially transverse to the movement of the machine and generally transverse to the horizontal component of shot in its blast and rebound paths. This transverse configuration has rendered the machine too wide for use in relatively narrow spaces and close to walls and other obstructions.

In the transverse system, wheels for moving the conveyor belt are located adjacent or even beyond the perimeter of the opening through which the shot is directed for cleaning. This forces the belt through a path which is wider than the widest transverse dimension of the opening 14. This feature combined with the buckets which extend outwardly from the belt when moving vertically up the sides of the machine, makes it impractical or almost impossible for moving the opening 14 relatively close to the wall or obstruction being cleaned when compared to the conveyor system of the invention described herein.

With the conveyor movement and configuration shown in FIG. 1, the problems of the transverse conveyor systems and other systems for recovering spent abrasive which require larger path relative to the opening are substantially overcome. The width of the machine may not be significantly greater than the width of opening 14 when measured transverse to the path of movement of the machine. With this configuration the width of opening 14 and the elevator structure can be such that the housing enclosing the opening need defines the maximum width. Accordingly, the sides of the opening or seal can be moved relatively close to a wall or any other obstruction without any impediment provided by the conveyor mechanism or other parts of the cleaning apparatus.

Figure 2:
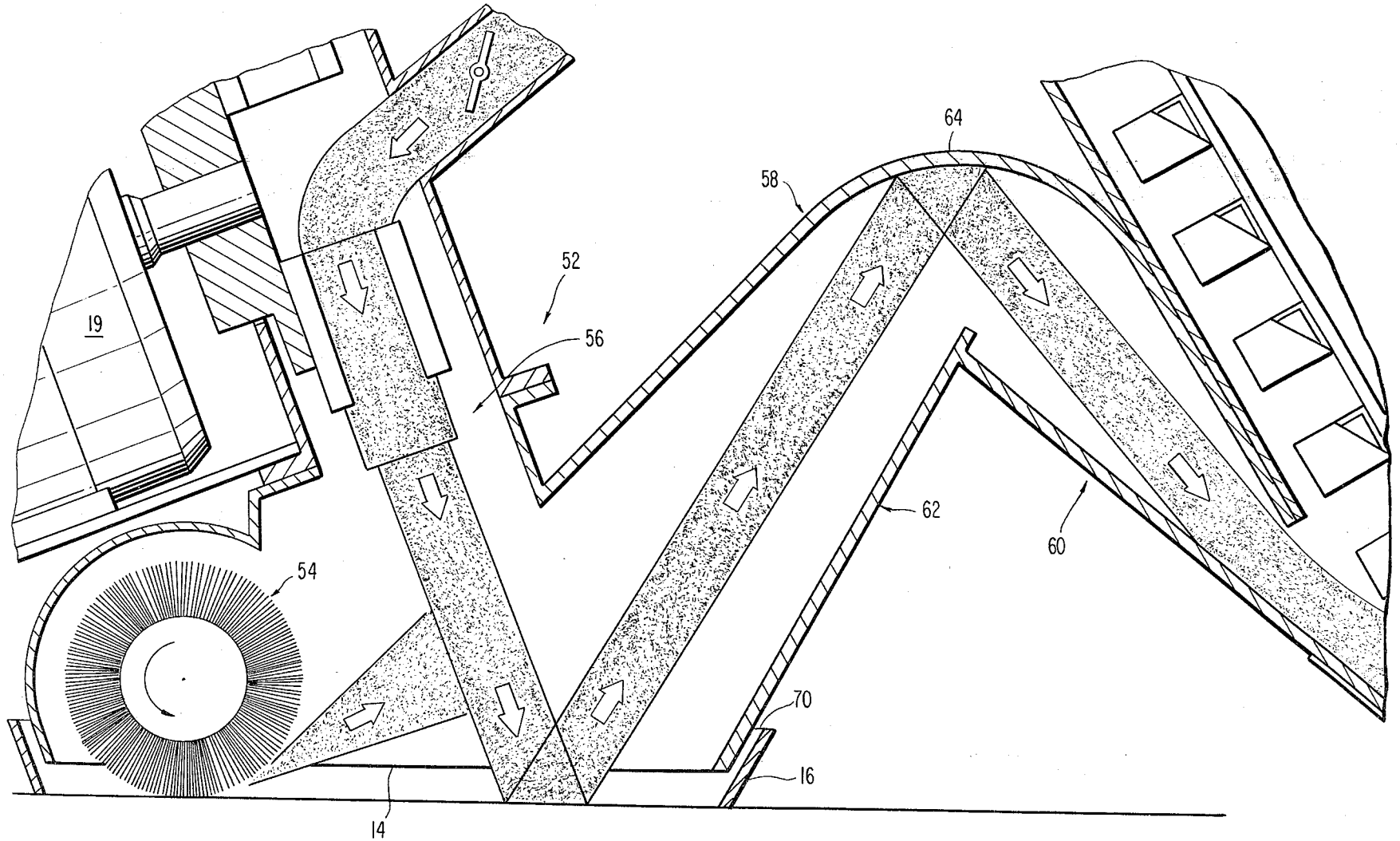
FIG. 2 shows a blow-up, cutaway portion of the apparatus in the area of the open side of the apparatus.

The configuration of blasting chamber 52 which surrounds opening 14, along with other cooperating elements, provide a simple and yet efficient apparatus for recovering spent abrasive. For the purposes of discussion the chamber 52 referred to herein, in connection with FIG. 2, includes that portion of the apparatus which is downstream of centrifugal wheel 18, upstream of the opening 14 and rearwardly of collection bin 20. Within these confines shot is delivered to the surface exposed by opening 14, rebounded and directed to collection bin 20. However, all of the shot and debris may not have sufficient kinetic energy to reach the collection bin. The materials will eventually fall to the surface 8. To recover materials from surface 8 a brush 54 is located rearwardly of the path of the abrasive as it is projected by centrifugal wheel 18 toward surface 8. Brush 54 extrends transversely of opening 14 and is journalled for rotation about any convenient shaft or bearing means in a counterclockwise direction rearwardly of the area impacted by the shot to sweep up residual shot and debris. As can be seen in FIG. 2 these residual materials are directed into the path of the downcoming shot such that it will be caught up by the force of the shot generated by centrifugal wheel 18 and directed to the collection bin 20 by the rebounding effect discussed above. Should some of the shot and debris pass through this path without being caught up in the downcoming shot, this shot may continue with the rebounding shot and simply pass into the collection bin 20 without the rebounding effect from surface 8.

By locating and employing a brush 54 in this manner, a separate compartment and return chute for the brush is not necessary. Rather, brush 54 is incorporated in the same chamber as the other apparatus for returning spent materials to collection chamber or bin 20. This reduces the complexity and cost in manufacturing and operating of the machine while maintaining, and even increasing, its efficiency in recovering spent abrasive and other debris.

Chute 58 provides part of the recovery apparatus for spent abrasive rebounding from surface 8. This chute directs the abrasive to collection bin 20 and reduces the kinetic energy of the abrasive particles such that they do not richochet from within collection bin 20. The chute diffuses the stream of rebounding abrasive passing to the collection bin through the action of a concentration section 62 and an attenuation section 60. The stream of particles flowing upwardly after rebounding from surface 8 are concentrated toward an upper concave surface 64 of chute 58 as shown in FIG. 2. From concave surface 64 the particles are then reflected downwardly toward the collection bin 20. By the time the particles reach collection bin 20 the kinetic energy has been attenuated to the extent that there will be little or no further richocheting within the collection bin itself. Consequently, the particles are sufficiently stable to allow buckets 36 to scoop accumulated material within collection bin 20 for delivery to hopper 22.

Buckets 36, as shown in FIG. 1 moving downwardly toward bin 20, are empty and have their open side facing toward bin 20. As they are moved about lower wheel 38, buckets 36 are rotated through the particles collected from a downwardly facing disposition to an upward facing disposition to gather material within the buckets. Buckets 36 are filled with material and then moved upwardly, and as they are rotated about upper wheel 40 the abrasive particles and other materials are thrown into hopper 22 for delivery to centrifugal wheel 18. The speed of the conveyor buckets may be controlled to insure proper dumping of the particles from the buckets into hopper 22.

The abrasive is stored in hopper 22 which is of a sufficient size to contain an adequate reserve of abrasive material for surface treating. Hopper 22 is in communication with centrifugal blasting wheel 18 via feeding passageway 30. Valve 32 is provided at the exit aperture of hopper 22 to provide a desired flow of abrasive from the hopper through the passageway into the blasting wheel. The desired rate of flow is influenced by numerous factors such as the size of the blasting wheel, the type of abrasive, the power available to the wheel, the type of surface being treated and the desired effect thereon. A normal rate of abrasive flow is frequently about 25 to 1000 pounds per minute, e.g. about 250 to 750 pounds per minute.

The centrifugal blasting wheel or whatever propelling apparatus is used, is oriented to deliver the abrasive to surface 8 at an angle of incidence coincident with the forward movement of the machine; however, the orientation could be counter to the forward movement. Frequently, the orientation is such that the propelled path of the abrasive i.e. the shot flow from the shot propelling source to the surface being treated, is from about 30° to less than 90°, preferably 45°–75°, relative to the surface being treated. In the device of the drawing the propelled path is generally downward. The abrasive due to the high speed at which it is propelled to the surface will rebound from surface 8. The angle at which the abrasive rebounds, i.e., the angle of reflectance, is a function of the angle of incidence, the configuration of the abrasive and the surface being treated at the point of impact, and the action of the abrasive on the surface. Generally, the angle of reflectance is diffused as the surface treated is often irregular. As depicted in FIGS. 1 and 2, a smooth surface and consistent configuration has been shown in which case the diffusion may not occur to a great extent during rebounding. In any event often a majority, e.g., at least about 60 or 75 percent, of the abrasive rebounds within about 15° or 20° of the theoretical angle of reflectance.

The rotating broom or brush 54 has sufficient rotational speed that the abrasive swept from the surface 8 is projected upwardly and into the blast path of the abrasive, and some may be projected toward and through chute 58. Under normal operating conditions, the rotating brush may be operated at about 200 to 750 rpm, preferably about 260 to 600 rpm. The bristles may be of any strong, erosion-resistant material such as nylon, polyolefin, steel or the like. It is particularly desirable to dislodge and remove all foreign matter, and with the rotating broom contacting the surface undergoing treatment both spent abrasive material and debris resulting from cleaning of the surface are removed from the surface and additional abrasive is recovered for reuse. By utilizing both chute 52 and rotating broom the removal of abrasive and foreign material from surface 8 is enhanced without significant labor and energy consumption.

The abrasive surface cleaning apparatus shown in FIGS. 1 and 2 is essentially a closed system allowing very little grit or dust or other debris to reach the atmosphere. With the continuous impacting of abrasive particles on the surface being treated, a great amount of grit and dust is accumulated with the removal of paint, rust or other substances from the surface. Desirably, means are provided for exhausting these contaminants from the blasting zone. Advantageously, even larger pieces of grit are exhausted from the apparatus since, for example, pieces of rust, paint and the like, having been to impact the surface, may stain the treated surface. In accordance with the invention a separation of this material may be accomplished by vacuum air duct 26. The debris is removed from the shot as it is dumped into hopper 22 and delivered to a debris collector (not shown) downstream of vacuum duct 26. Any convenient means can be used to draw a vacuum in duct 26, but typically a fan is employed with a filter against which particles are collected. As a result of the vacuum air may be drawn into the blast area through opening 70 between seal 16 and the enclosure around opening 14. This air flow may pass through the blast and rebound areas and through the elevator into duct 26.

The apparatus of the present invention can be self-propelled by providing one or more drive wheels, for instance, near the front of the apparatus, and can be powered by conventional means for example hydraulic, electric, internal combustion, or pneumatic drive means. As discussed above in the preferred embodiment an electric motor 42 is employed to drive the blasting machine 10. The apparatus normally operates whether self-propelled or externally propelled at speeds of about 0–150 ft. or more per minute depending upon the type of surface being treated and the desired effect thereon. Advantageously, the apparatus is designed so that the operator can vary the speed or even stop movement of the apparatus without terminating the treating operation. Controls for regulating the speed of the machine, the speed of the blasting device and the rotational speed of the rotary broom can be mounted near steering handle 48. In the embodiment as shown in FIG. 1, the control panel 50 is placed on the exterior portion of the enclosure adjacent the elevator.

The apparatus of the invention may be used in horizontal or inclined surfaces. Features of the invention may also be adapted in devices for treating vertically-disposed surfaces. While the apparatus has been described as being mobile and especially adapted for treating flat, horizontal surfaces it can be operated at a stationary position with the surface being treated moving past the opening in the enclosure. With the recovery of abrasive material utilizing the rebound of the abrasive as well as the rotating brush the accumulation of the abrasive on the surface being treated is retarded to avoid deleteriously affecting the surface being treated or necessitating extensive clean-up operations. Thus, the apparatus can continue to treat the surface while stationary moving slowly or even backwards.

The device of this invention is compact and is relatively maneuverable. Furthermore, since substantially all of the abrasive material can be removed from the surface and recycled the amount of spent abrasive which is lost is relatively small. This reduces the overall cost of the operation. Additionally, the energy of the rebounding particles is sufficiently utilized to enhance the recovery process. Moreover forward speed of the machine can be changed without surges of spent abrasive clogging the recycled mechanism. A particular advantage of the machine described above in addition to the compactness and simplicity of the recovery operation is the ability to operate in narrow areas and in close proximity to walls and other obstructions.

Various suitable abrasive material can be used in the apparatus. For example, metal shot, metal grit, sand, glass beads, metal oxide particles and stone. The choice of the particulate materials and the diameter of the sides thereof may depend upon the particular application and upon the specific surface composition of the material to be treated. Generally, spherical metal shot is preferred because of its durability and the desirable effect upon the surface being treated. Spherical shaped abrasive particles also give a good blast pattern on the surface and a more predictable angle of reflectance from the surface. However, this apparatus may be used with irregularly or angularly shaped particles. Such irregular particles are especially useful when a rough surface is desired for example, a nonskid surface. Conventionally used shot material will become rough and gritty. This irregular surface causes particles to richochet from the surface in an unpredictable manner, thus it is important to have the combined recovery systems of the invention. Under certain circumstances, it is desirable to use gritty materials in order to produce a rough surface, e.g. a nonskid surface. In this case, it is particularly advantageous to utilize a recovery system which can recover virtually 100% of the spent abrasive. Also, as the abrasive particles begin to break up, their mass is reduced; they will possess less kinetic energy, thereby increasing the probability that the particles will not be captured by rebounding in chute 58. However, the dual recovery system of this invention enables recycling of the smaller, but still useful abrasive particles which might otherwise be lost.

In operation the machine 10 is arranged over the surface, and may be positioned adjacent any obstructions or walls which may abut the surface to be cleaned. The operator through the control panel can place the machine in operation. Assuming the machine is directed to move forward the direction of the machine is controlled through arm 48. While in operation the abrasive in hopper 22 is fed through passageway 30 to centrifugal wheel 18. The wheel 18 in turn propels the abrasive material toward opening 14 to clean the surface exposed by the opening. As the machine is moved forward continuous portions of surface 8 are exposed to the blasting chamber opening for cleaning by abrasive material. As the abrasive material impacts the surface paint and other debris is removed from the surface and carried with the abrasive material during rebound through the path defined by chute 58 toward the collection bin. Simultaneously with this movement and rebound operation of the shot brush 54 sweeps debris and shot toward the downpath of shot propelled from centrifugal wheel 18. The shot and debris directed toward chute 58 is concentrated and attentuated and eventually delivered to collection bin 20. Alternatively, the rebounded material may be conveyed directly to the hopper for the blasting device or by various means, at least some of which are known in the art, see Dutch patent application No. 7612425. Thus the rebound path may extend to the hopper, and, if desired, this path may contain means for insuring the direct return of shot to the hopper, see, for example, U.S. Pat. No. 3,977,128.

The conveyor system of the machine shown in the drawing can be continuously operated to move buckets 36 through the shot and debris collected in collection bin 20 for scooping up these materials in each individual bucket and delivering them to a position above the hopper where they are unloaded by dumping into hopper 22. The area of the enclosure above the hopper is subjected to a low pressure or vacuum through low pressure duct 26 to draw away the dust and debris from the shot as it is being delivered to hopper 22.

The operation as described above is a continuous one and applies to the surface as the machine is moved typically in a linear path, but it can be moved in any path, over the surface which is to be cleaned. The movement across the path is repeated along an adjacent path until the entire surface is cleaned.

Although the operation above has been described in connection with a self-propelled device, the machine can be attached to some other motor means or pulled by an operator to move the machine through the desired path. Alternatively the apparatus may be supported in a fixed position with a carrier or other means for moving the surface to be treated past opening 14.

It is claimed:

1. A surface-treating apparatus comprising:

an enclosure having an opening adapted to be positioned adjacent a surface to be treated and expose the surface to said enclosure;

propelling means for propelling abrasive in a path through said opening of said enclosure against an exposed portion of the surface;

a blast chamber defined by said enclosure in communication with said opening;

means for recovering abrasive propelled against said exposed surface and rebounded therefrom;

means for recovering abrasive on said exposed portion of the surface by moving said abrasive into said path; and said means for recovering said abrasive on an exposed portion of the surface including brush means located within said blast chamber for directing abrasive on an exposed portion of the surface into said path for said abrasive from said propelling means.

2. The apparatus according to claim 1 wherein said brush means is a rotatable brush and said path is intermediate of said brush and said means for recovering abrasive propelled against an exposed portion and rebounded therefrom.

3. The apparatus according to claim 2 wherein said means for recovering abrasive propelled against an exposed portion and rebounded therefrom includes a collection bin, a conduit connecting said chamber to said collection bin, said conduit receiving abrasive rebounding from an exposed portion of the surface and attenuating the abrasive before delivery to said collection bin.

4. The apparatus according to claim 3 including recycling means for returning abrasive collected in said collection bin to said propelling means.

5. An apparatus for treating a surface with abrasive comprising:

an enclosure having an opening adapted to be positioned adjacent a surface;

propelling means for propelling abrasive particles in a flow path from said propelling means through said opening of the enclosure against a surface with sufficient energy to rebound therefrom;

sealing means around said opening for preventing abrasive from escaping from said enclosure between said opening and a surface;

collection means for collecting abrasive rebounding from a surface;

means for returning rebounded abrasive from said collection means to said propelling means; and a rotatable brush located within said opening for sweeping abrasive deposited on a surface exposed by the opening and directing abrasive into said path and toward said collection means.

6. The apparatus according to claims 1 or 5 wherein said propelling means includes a centrifugal wheel for directing abrasive toward the opening with sufficient kinetic energy to cause said abrasive to rebound after impacting against a surface.

7. An apparatus for treating a surface with abrasive comprising:

an enclosure having an opening adapted to expose a surface to said enclosure;

propelling means for propelling abrasive particles through said opening of the enclosure against a surface exposed by said opening;

sealing means around said opening for providing a seal about said opening between said enclosure and surface to prevent abrasive from escaping from said enclosure between said opening and surface;

a collection means for receiving abrasive rebounded from said surface after having been propelled against a surface by said propelling means;

a path defined by said apparatus between said opening and said collection means for receiving abrasive rebounded from said surface and directing said abrasive rebounded from said surface;

brush means positioned in said opening for directing abrasive on said surface to said collection means;

recycling means for returning abrasive collected in said collection means to said propelling means;

said collection means including a collection bin located downstream of said path for accumulating abrasive material directed by said path thereto; and said propelling means including means for propelling abrasive between said brush and said path and said brush directs at least a portion of the abrasive on said surface into abrasive being propelled from said propelling means toward said surface.

* * * * *